United States Patent [19]

Robyn et al.

[11] Patent Number: 4,542,888

[45] Date of Patent: Sep. 24, 1985

[54] ADDING TO SILICA REFRACTORY STRUCTURES

[75] Inventors: Pierre Robyn, Nivelles; Pierre Deschepper, Charleroi, both of Belgium

[73] Assignee: Glaverbel, Brussels, Belgium

[21] Appl. No.: 580,718

[22] Filed: Feb. 16, 1984

[30] Foreign Application Priority Data

Feb. 18, 1983 [GB] United Kingdom ..... 8304619

[51] Int. Cl.[4] ..... F27D 1/16

[52] U.S. Cl. ..... 266/44; 266/281; 264/30

[58] Field of Search ..... 266/281, 44, 280; 264/30

[56] References Cited

U.S. PATENT DOCUMENTS 3,994,676 11/1976 Strimple et al. ..... 266/281
4,257,990 3/1981 Thomas et al. ..... 264/30
4,452,749 6/1984 Kolvek et al. ..... 264/30

FOREIGN PATENT DOCUMENTS 71009 5/1950 Denmark ..... 266/44
1330894 9/1973 United Kingdom .
2110200 6/1983 United Kingdom .

*Primary Examiner*—L. Dewayne Rutledge
*Assistant Examiner*—S. Kastler
*Attorney, Agent, or Firm*—Spencer & Frank

[57] ABSTRACT

A silica refractory structure may be added to, e.g. by way of repair, in a working environment at a temperature in excess of 600° C. Such addition is made using one or more vitreous silica bricks bonded into position by projecting a mixture composed of finely divided particles of exothermically oxidizable material, e.g. Si optionally with Al and particles of silica, and burning the mixture during its projection to form a coherent refractory mass which bonds the addition together and to the original structure.

8 Claims, 4 Drawing Figures

ADDING TO SILICA REFRACTORY STRUCTURES

BACKGROUND OF THE INVENTION

This invention relates to a method of adding to a silica refractory structure in a working environment at a temperature in excess of 600° C.

The expression "silica" is used herein in the sense used in British Standard 3446 to define "silica refractory" as a refractory material which, in the fired state, contains not less than 92% $SiO_2$ by weight.

Principal uses of silica refractories are in steel furnaces, coke ovens, gas retorts and glass tank furnaces.

The invention may be used in the modification of an existing structure, for example in the building of a wall or duct to divert flue gases or for some other purpose, but it is presently believed that the major practical use of the present invention will lie in the field of repairing damaged structures, and the present specification will accordingly be directed mainly to the use of the invention in that way.

With the effluxion of time, silica refractory structures deteriorate for one reason or another, and they consequently require repair. Large furnaces take several days to cool to ambient from their working temperature, and they require a similar reheating time because the silicon dioxide in their structure, present in cristobalite and tridymite form is extremely sensitive to thermal shock at temperatures between 20° C. and 600° C. In particular, cristobalite is characterised by a crystalline inversion, generally between 200° C. and 250° C., which is accompanied by a change in length of about 1%.

It is accordingly desirable to effect any necessary repair while the silica refractory structure is hot. Unfortunately, the sensitivity of conventional refractory silica bricks to thermal shock effectively prevents their use in hot repair work unless they have been preheated. It will be appreciated that such preheating is also time-consuming.

It will be understood that it is necessary that a silica refractory wall should be repaired with silica refractory and not some other material in order to achieve compatibility, inter alia, of rates of expansion and thermal conductivity as between the repair and the original brickwork.

Hot repairs have in the past been carried out according to two distinct systems. In one such system, use is made of vitreous silica bricks. Vitreous silica has a very small coefficient of thermal expansion so that bricks at ambient temperature can be transferred immediately to the hot repair site without any substantial risk that they will crack due to thermal shock. The bricks are laid and their interstices are packed with granular refractory material to hold them in position. Such thermal expansion of the bricks as does take place further compresses the packing granules. Unfortunately, operating according to this system does not result in a very high quality repair, since the interstices between the vitreous silica bricks are not airtight. This is of very considerable importance in the case of coke ovens because of the different gas compositions inside and outside such ovens and is also important for example when repairing the roof of a glass melting tank furnace. Any flame which penetrates an interstice in the roof of such a furnace will rapidly erode the surrounding material so that further repair is soon required.

In the other such system, a mixture of finely divided particles of exothermically oxidisable material and particles of refractory material are projected against a surface and burned during projection so that under the heat of combustion a coherent refractory mass is formed on that surface. Particular examples of such processes are described in Glaverbel's British Patent Specification No. 1 330 894 and in copending British Patent Application No. 82 33 319 (Publication No. GB 2 110 200 A). Such processes can lead to highly effective repairs, but the rate of application of new material is not high, and where silicon is used as the or an exothermically oxidisable material (as is recommended or required in those specifications) the process is rather expensive especially for comparatively large repairs.

SUMMARY OF THE INVENTION

The present invention is based on an appreciation of the fact that, contrary to what would be expected, these two known systems can be modified and combined to provide a rapid, relatively inexpensive and highly effective repair or other addition to a silica refractory structure.

According to the present invention, there is provided a method of adding to a silica refractory structure in a working environment at a temperature in exees of 600° C. characterised in that such addition is made by using at least one vitreous silica brick which is bonded into position by projecting a mixture comprising finely divided particles of exothermically oxidisable material and particles of silica incombustible refractory material and burning the mixture during its projection to form a coherent refractory mass which effects such bonding.

The practice of the present invention results in an economical and effective repair to the silica refractory structure. Because the repair is effected at elevated temperature, cooling and reheating times are shortened and may be eliminated if the repair is effected substantially at the working temperature of the structure as is particularly preferred. The total time for which such structure is out of use is thus reduced as compared with rebricking at low or ambient temperature. Furthermore, any danger that existing brickwork not in need of repair will be damaged by cooling to such a low or ambient temperature (or by reheating to working temperature) is greatly reduced and may be eliminated. The time taken for the actual repair operation itself is also reduced as compared with repair wholly by forming refractory mass in situ as referred to above. Vitreous silica bricks are also less expensive than starter materials often used in such techniques.

The added vitreous silica brickwork is bonded in position by a coherent silica refractory mass formed in situ. Such bonding can readily be effected to form substantially airtight joints between the vitreous silica bricks and the neighbouring structure.

Vitreous silica, which may be and preferably is in the form of coherent granules of vitreous silica has a small coefficient of thermal expansion and is accordingly not susceptible to thermal shock when heated. The repair or other addition to the structure may simply be effected by placing vitreous silica bricks at ambient temperature into the site of the repair or other addition which is at an elevated temperature and bonding them into position. Within a few days of continued exposure to high temperature, it has been found that the vitreous silica bricks progressively crystallise to silica in tridymite and cristobalite form to reach the same structure as that of ordinary silica refractory bricks when they consequently have the same physical properties. It is surprising that the silica refractory mass formed in situ will form an effective bond not only with the original silica refractory structure but also with the added vitreous silica brickwork and also that the bond to the vitreous silica brickwork will remain effective during and after the transformation of the added silica brickwork from its vitreous to its crystalline form.

Advantageously, such vitreous silica brickwork is substantially entirely faced with such a coherent refractory mass.

Preferably, the or each vitreous silica brick is shaped and oriented so that a face thereof against which a said mixture is flame-sprayed has chamfered edges. The chamfered edges of adjacent bricks thus give rise to grooves into which the refractory mass is flame sprayed. This promotes bonding between adjacent bricks and provides a key for the facing when present.

As has previously been stated it is believed the invention will afford particular benefits when said addition is made to effect a repair to the original structure.

It is preferred that at least the greater part by weight of said finely divided particles of oxidisable material is constituted by silicon particles. This enhances the silicon dioxide content of the refractory mass formed in situ.

In some preferred embodiments of the invention said finely divided particles of oxidisable material comprise aluminium particles in an amount not exceeding 4% by weight of the mixture. The use of aluminium particles promotes evolution of heat during burning of the mixture as it is projected. By limiting the aluminium content of the mixture to 4%, the aluminium oxide content of the resulting refractory mass due to the burning of that aluminium is kept below 8% so that a silica refractory mass can be formed if the other particles projected consist of silicon and silicon dioxide.

BRIEF DESCRIPTION OF THE DRAWINGS

Certain preferred embodiments of the invention will now be described by way of example and with reference to the accompanying drawings, in which.

DESCRIPTION OF THE PREFERRED EMBODIMENTS

Figure 1:
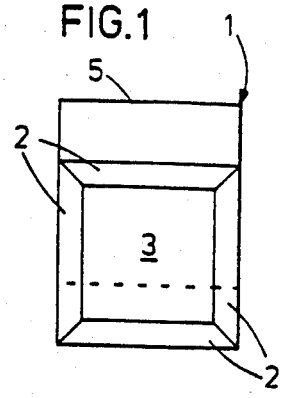
FIGS. 1 to 3 are respectively end, side and plan elevational views of a vitreous silica brick adapted for use in a method according to the invention.
Figure 2:
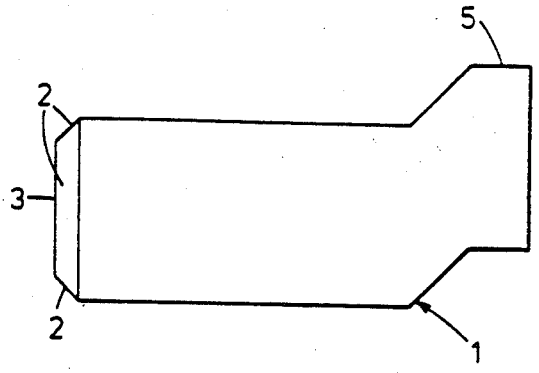
Figure 3:
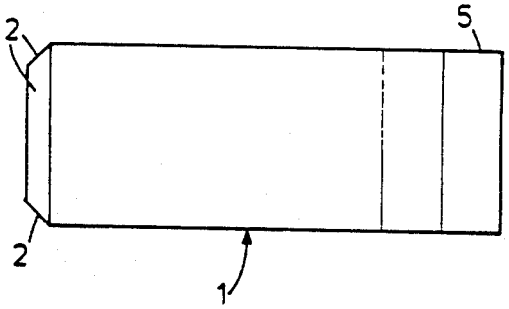

In FIGS. 1 to 3 of the drawings, a vitreous silica brick generally indicated at 1 is of generally square cross-section. The edges 2 of the nose face 3 of the brick are chamfered so as to define grooves (shown at 4 in FIG. 4) when such bricks are stacked together. The tail end 5 of the brick 1 is stepped up so as to provide a key to assist stacking in vertical registration. Again, compare FIG. 4.

Figure 4:
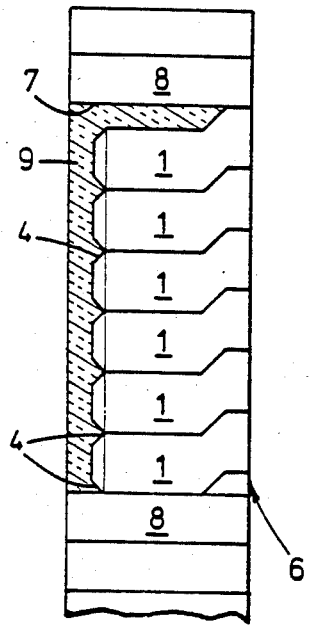
FIG. 4 illustrates a cross-section of a silica refractory wall repaired in accordance with the invention.

In FIG. 4, a damaged silica refractory wall 6 has been repaired by removing damaged refractory material to leave a hole 7 surrounded by good, original brickwork 8 and then rebricking the hole 7 using vitreous silica bricks 1 as illustrated in FIGS. 1 to 3. This process was performed substantially at the working temperature of the plant of which the wall, 6 formed a part.

After rebricking, the vitreous silica bricks 1 were faced with a refractory mass 9 formed in situ by a flame-spraying technique known per se.

In a specific practical example, a wall of a coke oven formed of silica refractory bricks mainly in the tridymite form was rebricked using vitreous silica bricks while at a temperature of 1150° C. All bad brickwork was removed and the area to be repaired was cleaned. The necessary vitreous silica bricks were placed, without preheating at the base of the wall. The bricks were then lifted into place course by course, bonding each course before the next was laid by a flame-spraying technique. After complete rebricking, the rebricked area was faced with refractory by the same flame spraying technique.

In this way a high quality repair was rapidly and inexpensively made.

After the vitreous silica bricks had been in the coke oven for a few days, they were found to have crystallised and adopted an internal structure very similar to that of the original brickwork.

The compositions of the vitreous, crystallised and original bricks is given below (parts by weight)

| Brickwork | Raw Vitreous Silica | Crystallised Silica | Original Silica Refractory |
|---|---|---|---|
| $SiO_2$ | 92.00 | 94.85 | 95.00 |
| CaO | 4.12 | 4.25 | 2.80 |
| MgO | 0.10 | 0.10 | — |
| $Al_2O_3$ | 0.38 | 0.39 | 0.80 |
| $Fe_2O_3$ | 0.24 | 0.25 | 0.80 |
| $Na_2O$ | 0.06 | 0.06 | 0.05 |
| $K_2O$ | 0.07 | 0.07 | 0.05 |
| $TiO_2$ | 0.03 | 0.03 | 0.50 |

Loss on firing 3.00

The bonding together and facing of the vitreous silica bricks was performed by projecting a starting mixture of 87% silicon dioxide, 12% silicon and 1% aluminium (by weight) delivered at a rate of 1 kg/minute in 200 L/minute (Normal) oxygen. The silicon dioxide used was made up of 3 parts cristobalite and 2 parts tridymite by weight with grain sizes between 0.1 and 2.0 mm. The silicon and aluminium particles each had an average grain size below 10 $\mu$m, with silicon having a specific surface of 4000 $cm^2/g$ and the aluminium a specific surface of 6000 $cm^2/g$. On combustion of the silicon and aluminium a coherent silica refractory mass was formed which bonded to the repaired wall area.

In order to test the effectiveness of the method of the present invention under conditions designed to simulate those in a coke oven, two walls were built under the conditions set forth in the above example. One of these walls was maintained at 1150° C. The other wall was repeatedly subjected to severe thermal shocks by ten times applying to it a water jacket and then reheating to 1150° C. At the end of the test the two walls were examined and no difference was found between them.

We claim:

1. A method of adding to a silica refractory structure while the structure is maintained at a temperature in excess of 600° C., comprising:

providing a mixture of particles of exothermically oxidisable material and particles of silica incombustible refractory material;

placing a vitreous silica brick, which has a temperature below that required to transform the silica brick from the vitreous to the crystalline state, into a desired position relative to the structure; and bonding the vitreous silica brick to the structure by projecting the mixture toward the position of the brick and burning the mixture during its projection to form a coherent refractory mass which effects such bonding.

2. A method according to claim 1, wherein the vitreous silica brick has an exposed face when placed into the desired position, and said bonding step includes applying a coherent refractory mass substantially entirely to the exposed face of the vitreous silica brick by projecting the mixture toward the face of the vitreous silica brick and burning the mixture during its projection.

3. A method according to claim 1, wherein the silica refractory structure is an original structure, and said method is employed to repair the original structure.

4. A method according to claim 1, wherein said providing step includes providing that at least the greater part by weight of the particles of oxidisable material is constituted by silicon particles.

5. A method according to claim 1, wherein said providing step includes providing that the particles of oxidisable material are comprised of aluminum particles in an amount not exceeding 4% by weight of the mixture.

6. A method according to claim 1, wherein said providing step includes providing the particles of exothermically oxidisable material with an average grain size below 10 $\mu$m.

7. A method according to claim 6, wherein said providing step includes providing that the particles of exothermically oxidisable material are constituted by silicon and aluminum particles, with the silicon particles having a specific surface of substantially 4000 $cm^2/g$ and the aluminum particles having a specific surface of substantially 6000 $cm^2/g$.

8. A method of adding to a silica refractory structure in a working environment at a temperature in excess of 600° C., comprising:

providing a mixture of particles of exothermically oxidisable material and particles of silica incombustible refractory material;

providing a vitreous silica brick with a face having chamfered edges;

placing the vitreous silica brick into a desired position relative to the structure so that the face with the chamfered edges is exposed;

bonding the vitreous silica brick to the structure by projecting the mixture toward said exposed face and burning the mixture during its projection to form a coherent refractory mass which effects such bonding.

* * * * *